US011587578B2

(12) United States Patent
Lin

(10) Patent No.: US 11,587,578 B2
(45) Date of Patent: Feb. 21, 2023

(54) METHOD FOR ROBUST DIRECTED SOURCE SEPARATION

(71) Applicant: Plantronics, Inc., Santa Cruz, CA (US)

(72) Inventor: Xiao Lin, Fremont, CA (US)

(73) Assignee: PLANTRONICS, INC., Santa Cruz, CA (US)

( * ) Notice: Subject to any disclaimer, the term of this patent is extended or adjusted under 35 U.S.C. 154(b) by 121 days.

(21) Appl. No.: 17/166,831

(22) Filed: Feb. 3, 2021

(65) Prior Publication Data

US 2022/0246169 A1 Aug. 4, 2022

(51) Int. Cl.

| | |
|---|---|
| ***G10L 25/78*** | (2013.01) |
| ***H04R 3/00*** | (2006.01) |
| ***H04R 5/033*** | (2006.01) |

(52) U.S. Cl.

CPC ..... *G10L 25/78* (2013.01); *H04R 3/005* (2013.01); *G10L 2025/786* (2013.01); *H04R 5/033* (2013.01)

(58) Field of Classification Search

CPC ... G10L 25/78; G10L 21/028; G10L 21/0208; G10L 21/032; G10L 25/84; G10L 2025/786; H04R 3/005; H04R 5/033

See application file for complete search history.

(56) References Cited

U.S. PATENT DOCUMENTS

2012/0269332 A1* 10/2012 Mukund ..... H04S 3/006 704/201

2020/0286500 A1* 9/2020 Mukund ..... G10L 21/028

* cited by examiner

*Primary Examiner* — Yogeshkumar Patel

(57) ABSTRACT

An apparatus includes an interface for microphones, a separated source processor configured to analyze channels from the microphones, and a voice activity detector (VAD) circuit. The VAD circuit is configured to generate a voice estimate (VE) value. The VE value is to indicate a likelihood of human speech received by the microphones. Generating the VE value includes adjusting the VE value based upon a delay between two of the microphones. The VAD circuit is configured to provide the VE value to the separated source processor.

20 Claims, 4 Drawing Sheets

METHOD FOR ROBUST DIRECTED SOURCE SEPARATION

FIELD

The present disclosure relates generally to the field of head worn audio devices. More particularly, the present disclosure relates to providing an improved voice signal of a user's voice, captured with a plurality of microphones, using a method for robust directed source separation.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

Mobile communication devices having audio recording capabilities are ubiquitous today for various applications. Most prominently, smart phones, tables, and laptops allow placing audio and video call and enable communications with unprecedented quality. Similarly, ubiquitous is the use of head-worn audio devices, such as in particular headsets. Headsets allow 'hands-free' operation and are thus being employed in commercial applications, office environments, and while driving.

An issue with the mobility of modern communication devices relates to the fact that the devices can be brought almost anywhere, which may lead to use in loud environments. In these environments, a common problem is that the microphone picks up on the environmental noise in a substantial way, making the user's voice hard to understand by the receiver of the call. The problem is particularly prominent with background noise comprising speech of other persons as voice band filtering in such scenarios cannot remove such noise to a satisfactory extent.

Thus, an object exists to improve the quality of a voice signal, in particular in noisy environments.

SUMMARY

Embodiments of the present disclosure may include an apparatus. The apparatus may include interfaces for communicatively coupling with microphones. The apparatus may include a separated source processor configured to analyze a plurality of channels from the microphones. The apparatus may include a voice activity detector (VAD) circuit configured to generate a voice estimate (VE) value. The VE value may be to indicate a likelihood of human speech received by one or more of the microphones. Generating the VE value may include adjusting the VE value based upon a delay between two of the microphones. The VAD may be configured to provide the VE value to the separated source processor.

Embodiments of the present disclosure may include a method. The method may include receiving input signals from microphones. The method may include generating a VE value. The VE value may be to indicate a likelihood of human speech received by the microphones. Generating the VE value may include adjusting the VE value based upon a delay between two of the microphones. The method may include providing the VE value to a separated source processor.

Embodiments of the present disclosure may include an article of manufacture. The article may include a non-transitory medium. The medium may include instructions. The instructions, when loaded and executed by a processor, may cause the processor to receive input signals from microphones. The instructions may be further to cause the processor to generate a VE value. The VE value may indicate a likelihood of human speech received by one or more of the microphones, wherein generating the VE value includes adjusting the VE value based upon a delay between two of the microphones. The instructions may be further to cause the processor to provide the VE value to a separated source processor.

The details of one or more embodiments are set forth in the accompanying drawings and the description below. Other features will be apparent from the description, drawings, and from the claims.

DETAILED DESCRIPTION

Figure 1:
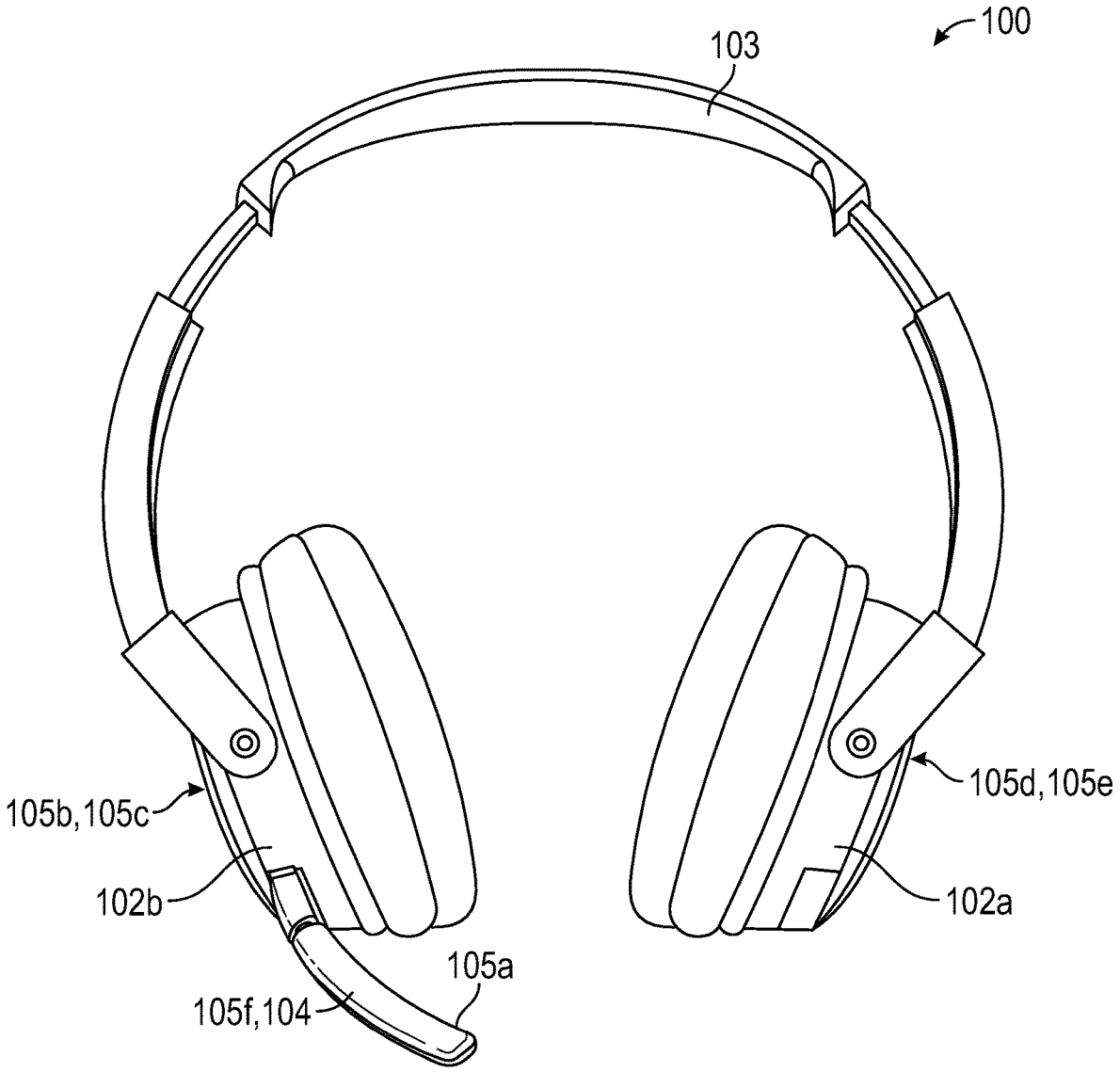
FIG. 1 shows a front view of an embodiment of a head-worn audio device such as a headset, according to embodiments of the present disclosure.

Specific embodiments of the invention are here described in detail, below. In the following description of embodiments of the invention, the specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In the following explanation of the present invention according to the embodiments described, the terms "connected to" or "connected with" are used to indicate a data and/or audio (signal) connection between at least two components, devices, units, processors, or modules. Such a connection may be direct between the respective components, devices, units, processors, or modules; or indirect, i.e., over intermediate components, devices, units, processors, or modules. The connection may be permanent or temporary; wireless or conductor based.

For example, a data and/or audio connection may be provided over direct connection, a bus, or over a network connection, such as a WAN (wide area network), LAN (local area network), PAN (personal area network), BAN (body area network) comprising, e.g., the Internet, Ethernet networks, cellular networks, such as LTE, Bluetooth (classic, smart, or low energy) networks, DECT networks, ZigBee networks, and/or Wi-Fi networks using a corresponding suitable communications protocol. In some embodiments, a USB connection, a Bluetooth network connection and/or a DECT connection is used to transmit audio and/or data.

In the following description, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between like-named elements. For example, a first element is distinct from a second element, and the first element may encompass more than one element and succeed (or precede) the second element in an ordering of elements.

As communication devices gain mobility, a need exists to allow proper communication with such a device irrespective of the environment of the user. Thus, it is desirable to enable clear communications also in noisy environments, such as near a busy road, while travelling, and in shared office environments, restaurants, etc. A particular issue is given when the noise environments comprise speech or talk of other persons and in particular "distractor speech" from a specific unknown direction, which may decrease the ability of typical noise reduction systems, for example employing frequency band filtering. The present invention aims at enabling communications in the aforementioned noisy environments.

In one aspect, a head-worn audio device having a circuit for voice signal enhancement, is provided. According to this aspect, the circuit comprises at least a plurality of microphones, a directivity pre-processor, and a source-separation processor, also referred to as "SS processor" in the following. In another aspect, such a circuit may be located elsewhere from the head-worn audio device, such as in an electronic device communicatively coupled to the head-worn audio device. The SS processor may implement any suitable source-separation, such as directed source separation (DSS) or blind source separation (BSS).

The plurality of microphones of the present exemplary aspect are arranged as part of the audio device at positions, relative to the user's mouth. For example, the position of one or more of the plurality of microphones may be (pre) defined/fixed when the user is wearing the head-worn audio device.

It is noted that a "predefined" or "fixed" positioning of some of the microphones encompasses setups, where the exact positioning of the respective microphone relative to a user's mouth, may vary slightly. For example, when the user dons the audio device, doffs the audio device, and dons the audio device again, it will be readily understood that a slight positioning change relative to the user's mouth easily may occur between the two "wearing sessions". Also, the relative positioning of the respective microphone to the mouth may differ from one user to another. This nevertheless means that at a given time, e.g., in one given "wearing session" of the same user, the microphones have a fixed relative position.

In some embodiments, at least one microphone is arranged on a microphone boom that can be adjusted in a limited way. Typically, such arrangement is considered to be predefined, in particular when the boom only provides a limited adjustment, since the microphone stays relatively close to the user's mouth in any event.

The microphones may be of any suitable type, such as dynamic, condenser, electret, ribbon, carbon, piezoelectric, fiber optic, laser, or MEMS type. At least one of the microphones is arranged so that it captures the voice of the user, wearing the audio device. One or more of the microphones may be omnidirectional or directional. Each microphone provides a microphone signal to the directivity pre-processor, either directly or indirectly via intermediate components. In some embodiments, at least some of the microphone signals are provided to an intermediate circuit, such as a signal conditioning circuit, connected between the respective microphone and the directivity pre-processor for one or more of, e.g., amplification, noise suppression, and/or analog-to-digital conversion.

The directivity pre-processor is configured to receive the microphone signals and to provide at least two channels—which may include least a voice signal and a noise signal—to the SS or processor from the received microphone signals. In the present context, the terms "voice signal" and "noise signal" are understood as an analog or digital representation of audio in time or frequency domain, wherein the voice signal comprises more of the user's voice, compared to the noise signal, i.e., the energy of the user's voice in the voice signal is higher, compared to the noise signal. The voice signal may also be referred to as a "mostly voice signal", while the noise signal may also be referred to as a "mostly noise signal". The term "energy" is understood herein with its usual meaning, namely physical energy. In a wave, the energy is generally considered to be proportional to its amplitude squared.

When the SS processor is implemented as a BSS processor, the BSS processor is connected with the directivity pre-processor to receive at least a voice signal and a noise signal. The BSS processor is configured to execute a blind source separation algorithm on at least the voice signal and the noise signal and to provide at least an enhanced voice signal with reduced noise components. In this context, the term "blind source separation", also referred to as "blind signal separation", is understood with its usual meaning, namely, the separation of a set of source signals (signal of interest, i.e., voice signal, and noise signal) from a set of mixed signals, without the aid of information or with very little information about the source signals or the mixing process. Details of Blind Source Separation can be found in Blind Source Separation—Advances in Theory, Algorithms, and Applications, Ganesh R. Naik, Wenwu Wang, Springer Verlag, Berlin, Heidelberg, 2014, incorporated by reference herein.

When the SS processor is implemented as a DSS processor, the DSS processor may be configured to separate out a target voice signal and ambient noise into separate outputs. DSS may be tuned for, for example, human intelligibility, command recognition, or voice search. The microphones of the system are positioned to assume that the target voice needs to be discriminated from ambient noise along both horizontal and vertical directions. In both these cases, the preferred direction of the target voice is perpendicular to the device. However, the voice source could itself be moving in the vicinity of the preferred direction. The DSS algorithm adapts dynamically to the changing angles of incidence of target voice.

The enhanced voice signal provided by the SS processor may then be provided to another component of the audio device for further processing. In some embodiments, the enhanced voice signal is provided to a communication module for transmission to a remote recipient. In other embodiments, the enhanced voice signal is provided to a recording unit for at least temporary storage. The head-worn audio device may be considered a speech recording device in this case.

The directivity pre-processor and the SS processor may be of any suitable type. For example, and in some embodiments, the directivity pre-processor and/or the SS processor may be provided in corresponding dedicated circuity, which may be integrated or non-integrated. Alternatively, and in some embodiments, the directivity pre-processor and/or the SS processor may be provided in software, stored in a memory of the audio device, and their respective functionalities is provided when the software is executed on a common or one or more dedicated processing devices, such as a CPU, microcontroller, or DSP.

The audio device in further embodiments certainly may comprise additional components. For example, the audio device in one exemplary embodiment may comprise additional control circuity, additional circuitry to process audio, a wireless communications interface, a central processing unit, one or more housings, and/or a battery.

The term "signal" in the present context refers to an analog or digital representation of audio as electric signals. For example, the signals described herein may be of pulse code modulated (PCM) type, or any other type of bit stream signal. Each signal may comprise one channel (mono signal), two channels (stereo signal), or more than two channels (multichannel signal). The signal(s) may be compressed or not compressed.

In some embodiments, the directivity pre-processor is configured to generate a plurality of voice candidate signals and a plurality of noise candidate signals from the microphone signals.

According to the present embodiments, so-called "candidate signals" are generated from the microphone signals. As will be discussed in the following in more detail and in some embodiments, the voice signal and the noise signal, provided by the directivity pre-processor to the SS processor, are selected from the candidate signals.

In some embodiments, each of the candidate signals corresponds to a predefined microphone directivity, which microphone directivity may be predefined by the respectively predefined or fixed microphone positions. In some embodiments, the candidate signals have a unique directivity, i.e., not two of the noise candidate signals and not two of the voice candidate signals have the same directivity.

The term "directivity" or "spatial directivity" in some embodiments may be based on microphone directionality (omnidirectional or directional) considering the respective microphone's position. Alternatively or additionally, and in some embodiments, a desired microphone directivity may also be created by multiple microphone processing, i.e., by using multiple microphone signals. In both cases, the microphone directivity defines a three-dimensional space or "subspace" in the vicinity of the respective microphone(s), where the microphone(s) is/are highly sensitive.

In some embodiments, the directivity pre-processor comprises a microphone definition database and a spatial directivity module to generate the plurality of the voice candidate signals and the plurality of the noise candidate signals.

In the present embodiments, the microphone definition database comprises at least information referring to the positioning of each of the microphones, relative to the user's head or mouth. The microphone definition database may comprise further microphone-related data, such as microphone type, directionality pattern, etc. The microphone definition database may be of any suitable type and, e.g., comprise suitable memory.

The spatial directivity module may be of any suitable type to generate the candidate signals. The spatial directivity module may be provided in corresponding dedicated circuity, which may be integrated or non-integrated. Alternatively and in some embodiments, the spatial directivity module may be provided in software, stored in a memory of the audio device, and their respective functionalities is provided when the software is executed on a common or one or more dedicated processing devices, such as a CPU, microcontroller, or DSP.

For example, the spatial directivity module may be configured to generate the voice candidate signals based on the respective microphone's positioning and directivity. In this example, the microphone definition database may provide that one or more of the microphones are close to the user's mouth during use or a pointed towards the user's mouth. The spatial directivity module may then provide the corresponding microphone signals as voice candidate signals.

In some embodiments, the spatial directivity module may be configured as a beamformer to provide candidate signals with a correspondingly defined directivity.

In some embodiments, the spatial directivity module uses two or more of the microphone signals to generate a plurality of candidate signals therefrom. As will be apparent to one skilled in the art, having two microphones at known positions, it is for example possible to generate four candidate signals, each having a unique directivity or "beam form". The spatial directivity module in some embodiments may be configured with one of the following algorithms to generate the candidate signals, which algorithms are known to a skilled person:

Delay-sum;

Filter-sum;

Time-frequency amplitude and delay source grouping/clustering.

In some embodiments, the directivity pre-processor is further configured to equalize and/or normalize at least one of the voice candidate signals and the noise candidate signals. In some embodiments at least one of the plurality of voice candidate signals and the plurality of noise candidate is equalized and/or normalized.

An equalization and normalization, respectively, provides that each candidate signal of the respective plurality or group of candidate signals has at least an approximately similar level and frequency response. It is noted that while it is possible in some embodiments to conduct the equalization/normalization over all of the candidate signals, in some other embodiments, an equalization/normalization is conducted per group, i.e., the voice candidate signals on the one hand, and the noise candidate signals on the other hand. This group-wise equalization and/or normalization may be sufficient to the later selection of one of the voice candidate signals as the voice signal and the selection of one of the noise candidate signals as noise signals.

Suitable equalization and normalization methods include a typical EQ, a dynamic EQ, and an automatic gain control.

With respect to the noise candidate signals and/or the voice candidate signals and in some embodiments, the equalization and/or normalization is conducted with respect to diffused speech-like noise, e.g., using Hoth Noise and/or ITU-T G.18 composite source signal (CSS) noise.

In some embodiments, the equalization and/or normalization is based on a set of parameters, derived during manufacturing or design of the head-worn audio device. In other words, based on a set of calibration parameters. In some embodiments, the directivity pre-processor comprises one or more suitable equalization and/or normalization circuits.

In some embodiments, the directivity pre-processor further comprises a voice candidate selection circuit, wherein the voice candidate selection circuit selects one of the voice candidate signals as the voice signal and provides the voice signal to the SS processor.

The selection circuit may be configured with any suitable selection criterium to select the voice signal from the voice candidate signals. In one example, a speech detector is provided to analyze each voice candidate signal and to provide a speech detection confidence score. The voice candidate signal that has received the highest or maximum confidence is selected as voice signal.

In some embodiments, the voice candidate selection circuit is configured to determine an energy of each of the voice candidate signals and selects the voice candidate signal having the lowest energy as the voice signal. In the context of this explanation and as discussed in the preceding, the term "energy" is understood with its usual meaning, namely physical energy. In a wave, the energy of the wave is generally considered to be proportional to its amplitude squared. Since each candidate signal corresponds to acoustic waves are captured by one or more of the microphones, the energy of each of the voice candidate signals corresponds to the sound pressure of these underlying acoustic waves. Thus, "energy" also is referred to as "acoustic energy" or "wave energy" herein.

In some embodiments, the voice candidate selection circuit is configured to determine the energy of each of the voice candidate signals in a plurality of sub-bands. For example, a typical 12 kHz voice band may be divided into 32 equal sub-bands and the voice candidate selection circuit may determine the energy for each of the sub-band. The overall energy may in that case be determined by forming an average, median, etc. In some embodiments, a predefined weighing is applied that is specific to voice characteristics.

In some embodiments, the directivity pre-processor further comprises a voice activity detector wherein the voice candidate selection circuit selects one of the voice candidate signals as the voice signal if the voice activity detector determines the presence of the user's voice.

The voice activity detector (VAD) is operable to perform speech processing on, and to detect human speech within, the noise suppressed input signals. The voice activity detector comprises corresponding filters to filter non-stationary noise from the microphone signals. This enhances the speech processing. The voice activity detector estimates the presence of human speech in the audio received at the microphones.

With respect to the processing of the noise candidate signals and in some embodiments, the directivity pre-processor further comprises a voice filter, configured to filter voice components from each of the noise candidate signals. The voice filter may in some embodiments comprise a parametric filter, set for voice filtering.

In some embodiments, the voice filter is configured to receive at least one of the voice candidate signals and to filter the voice components using the received at least one voice candidate signal. The present embodiments are based on the recognition that an effective removal of voice components from the noise candidate signals is possible by applying a subtractive filter using the at least one voice candidate signal as input to the filter. In some embodiments, the voice signal is used to filter the voice components from the noise candidates.

In some embodiments, the head-worn audio device is a hat, a helmet, (smart) glasses, or a cap.

In some embodiments, the head-worn audio device is a headset.

In the context of this application, the term "headset" refers to all types of headsets, headphones, and other head worn audio playback devices, such as for example circum-aural and supra-aural headphones, ear buds, in ear headphones, and other types of earphones. The headset may be of mono, stereo, or multichannel setup. The headset in some embodiments may comprise an audio processor. The audio processor may be of any suitable type to provide output audio from an input audio signal. For example, the audio processor may be a digital sound processor (DSP).

In some embodiments, the audio device comprises at least three microphones. In some embodiments, the audio device comprises at least 5 microphones. Depending on the application, an increased number of microphones may improve the discussed functionality of the audio device further.

In some embodiments, the audio device comprises an audio output to transmit at least the enhanced voice signal to a further device. For example, the audio output may be provided as a wireless communication interface, so that the enhanced voice signal may be provided to the further device. The latter for example may be a phone, smart phone, smart watch, laptop, tablet, computer. It is noted that in some embodiments, the audio output may allow for a wire-based connection.

Embodiments of the present disclosure may include an apparatus. The apparatus may be a circuit, processor, submodule, component, or other part of a headset. The apparatus may include interfaces for communicatively coupling with microphones. The interfaces may receive signals from microphones in any suitable manner. The apparatus may include or be communicatively coupled to a separated source processor configured to analyze a plurality of channels from the microphones. The apparatus may include a voice activity detector (VAD) circuit configured to generate a voice estimate (VE) value. The VAD circuit may be implemented by, for example, software, firmware, combinatorial logic, control logic, a field programmable gate array, an application specific integrated circuit, programmable hardware, analog circuitry, digital circuity, or any suitable combination thereof. The VE value may be to indicate a likelihood of human speech received by one or more of the microphones. The VE value may be determined from one or more candidate VE values. The candidate VE values may be determined through analysis of the microphone signals in view of one or more distractor angles modeling approaches of sound to the system. Generating the VE value may include adjusting the VE value based upon a delay between two of the microphones. Adjusting the VE value may include selecting one of the candidate VE values based on a delay between the microphones. The VAD may be configured to provide the VE value to the separated source processor.

In combination with any of the above embodiments, the VAD circuit may be further configured to adjust the VE value by evaluating a range of possible values of the delay. The VAD circuit may select candidate delay values, evaluate candidate VE values based upon these candidate delay values, and select a VE value as the output based upon an analysis of the VE values. The selection of a different VE value using a possible value of the delay may thus be an adjustment of the VE value.

In combination with any of the above embodiments, the VAD circuit may be further configured to adjust the VE value by selecting a candidate VE value given a range of possible values of the delay. The candidate selected may be a lowest value among a range of candidate VE values given the range of possible values of the delay. The candidate VE values may be calculated based on given possible values of the delay.

In combination with any of the above embodiments, the VAD circuit may be further configured to adjust the VE value based upon an adjustment of a physical position of one of the microphones. An adjustment of the physical position of a microphone may cause a change in the delay between two of the microphones, and the VAD circuit may adjust the VE value based on the change in the delay.

In combination with any of the above embodiments, the VAD circuit may be further configured to adjust the VE value based upon a frequency response of one of the microphones. In a further embodiment, the VAD circuit may be further configured to adjust the VE value based upon a difference in frequency responses between two of the microphones. The difference in frequency responses may be accounted for by a direct source separation coefficient, which may form a characteristics representing the frequency response of the microphones.

In combination with any of the above embodiments, the VAD circuit may be further configured to adjust the VE value by evaluating a range of possible values of characteristics representing the frequency response of the microphones. The evaluation of the range of possible values of the characteristics may be performed by evaluating candidate VE values that arise from the different values of the range of possible values of the characteristics. In a further embodiment, the VAD circuit may be further configured to adjust the VE value by selecting a lowest candidate VE value given a range of possible values of characteristics representing the frequency response of the microphones.

Embodiments of the present disclosure may include a method. The method may include operations of any of the above apparatuses, including receiving input signals from microphones. The method may include generating a VE value. The VE value may be to indicate a likelihood of human speech received by the microphones. Generating the VE value may include adjusting the VE value based upon a delay between two of the microphones. The method may include providing the VE value to a separated source processor. The method may be performed by, for example, software, firmware, combinatorial logic, control logic, a field programmable gate array, an application specific integrated circuit, programmable hardware, analog circuitry, digital circuity, or any suitable combination thereof.

An article of manufacture may include a non-transitory medium. The medium may include instructions. The instructions, when loaded and executed by a processor, may cause the processor to receive input signals from microphones. The instructions may be further to cause the processor to perform any of the methods of the present disclosure.

Reference will now be made to the drawings in which the various elements of embodiments will be given numerical designations and in which further embodiments will be discussed.

Specific references to components, process steps, and other elements are not intended to be limiting. Further, it is understood that like parts bear the same or similar reference numerals when referring to alternate figures. It is further noted that the figures are schematic and provided for guidance to the skilled reader and are not necessarily drawn to scale. Rather, the various drawing scales, aspect ratios, and numbers of components shown in the figures may be purposely distorted to make certain features or relationships easier to understand.

FIG. 1 shows a front view of an embodiment of a head-worn audio device, namely in this embodiment a headset 100, according to embodiments of the present disclosure. Headset 100 may include two earphone housings 102*a*, 102*b*, which may be formed with respective earphone speakers 106*a*, 106*b* (not shown in FIG. 1) to provide an audio output to a user during operation, i.e., when the user is wearing the headset 100. Earphones 102*a*, 102*b* may be connected with each other over via an adjustable head band 103. Headset 100 may further comprise a microphone boom 104 with a microphone 105*a* attached at its end. Moreover, boom 104 may include a microphone 105*f* located midway between the ends of boom 104. Further microphones 105*b*, 105*c*, 105*d*, and 105*e* may be provided in earphone housings 102*a*, 102*b*. Microphones 105*a*-105*e* may allow for voice signal enhancement and noise reduction, as will be discussed in the following in more detail. It is noted that the number of microphones may vary depending on the application.

Headset 100 may allow for a wireless connection via Bluetooth to a further device, e.g., a mobile phone, smart phone, tablet, computer, etc., in a usual way, for example for communication applications.

Figure 2:
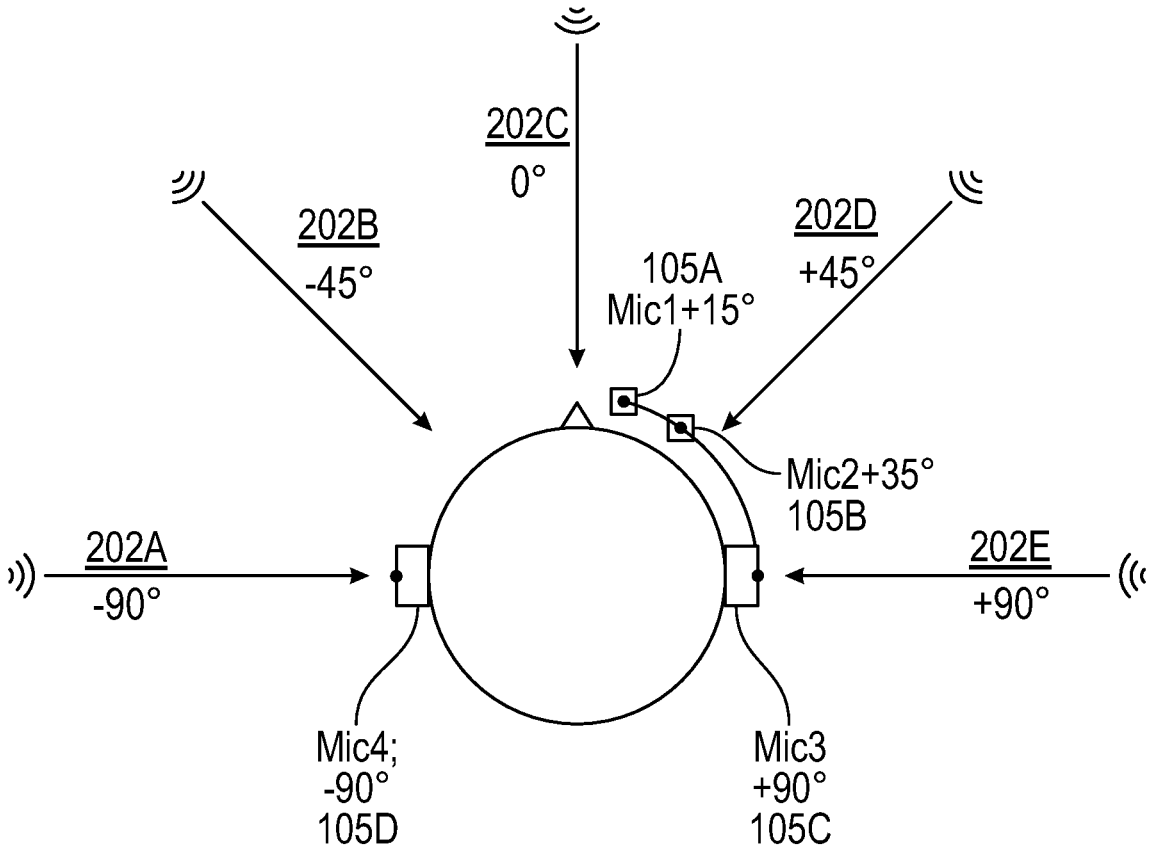
FIG. 2 shows a top-down view of an embodiment of the headset while being worn by a user, according to embodiments of the present disclosure.

FIG. 2 shows a top-down view of an embodiment of a head-worn audio device, such as headset 100, while being worn by a user, according to embodiments of the present disclosure. In particular, FIG. 2 illustrates positions of various microphones 105 of headset 100 within the horizontal plane. Given N microphones, each microphone may be referenced as micN. Assuming the user is facing towards to the top of the page, representing a position of 0°, microphone mic1 (105*a*) may be located near the front of a user at, for example, approximately +15°. Microphone mic2 (105*f*) may be located at an angle of approximately +35°. Microphone mic3 (105*b*) may be located at an angle of +90°. Microphone mic4 (105*d*) may be located at an angle of −90°.

Also illustrated in FIG. 2 is a model of how sources of noise may be transmitted along theoretical angles, referred to distractor angles 202. While noise may arise from anywhere surrounding headset 100, the model may be used to account for noise by modelling noise in vectors represented by distractor angles 202. Although a particular number of distractor angles 202 and specific angle values chosen are illustrated, the model of noise may utilize any suitable number of distractor angles 202 and angles thereof. The model of noise provided by distractor angles 202 may be used to reduce distractor or noise influence on data signals provided by headset 100, as will be discussed in greater detail below.

Example distractor angles 202 may include a distractor angle 202A at −90°, distractor angle 202B at −45°, distractor angle 202C at 0°, distractor angle 202D at +45°, and distractor angle 202E at +90°. The set of different distractor angles may be indexed by m, and there may be Nm different distractor angles 202 within a whole set.

Figure 3:
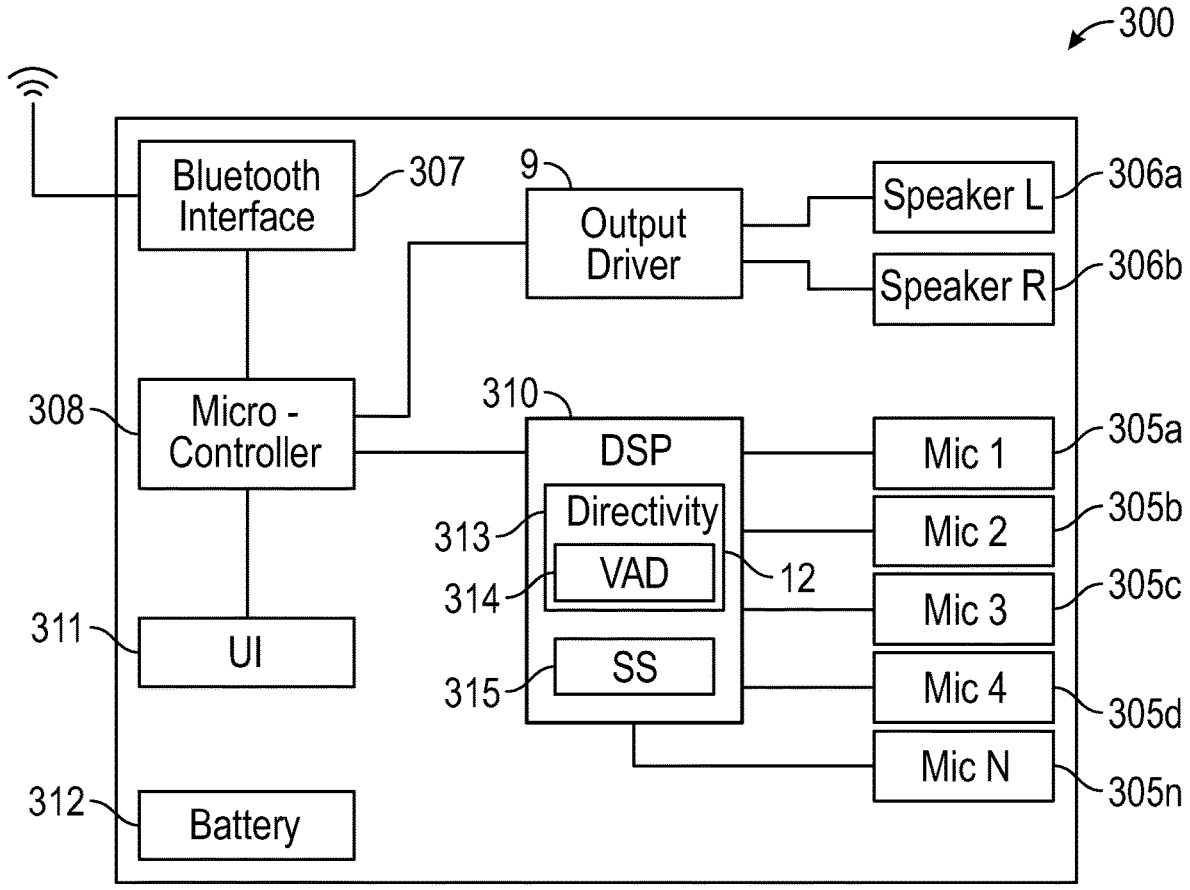
FIG. 3 shows a schematic block diagram of a circuit for the headset, according to embodiments of the present disclosure.

FIG. 3 shows a schematic block diagram of circuit 300 for headset 100, according to embodiments of the present disclosure.

Circuit 300 may include interfaces for speakers 306 and microphones 305. Circuit 300 may include a Bluetooth interface circuit 307 for connection with further devices. A microcontroller 308 may be provided to control the connection with the further device. Incoming audio from the further device is provided to output driver circuitry 309, which may include a D/A converter, and an amplifier. Audio, captured by the microphones 305A-305N may be processed by a digital signal processor (DSP) 310, as will be discussed in further detail in the following. An enhanced voice signal and an enhanced noise signal is provided by DSP 310 to the microcontroller 308 for transmission to the further device.

In addition to the above components, a user interface 311 may allow the user to adjust settings of headset 100, such as ON/OFF state, volume, etc. Battery 312 may supply operating power to all of the aforementioned components. It is noted that no connections from and to battery 312 are shown so as to not obscure the figure. In one embodiment, the components of circuit 300 may be implemented within earphone housings 102A, 102B.

Headset 100 according to the present embodiment is particularly adapted for operation in noisy environments and to allow the user's voice to be well captured even in an environment having so-called "distractor speech". Accordingly, DSP 310 may be configured to provide an enhanced voice signal with reduced noise components to the microcontroller 308 for transmission to the further device via the Bluetooth interface 307. DSP 310 may also provide an enhanced noise signal to microcontroller 308. The enhanced noise signal allows an analysis of the noise environment of the user for acoustic safety purposes.

The operation of DSP 310 may be based on BSS or DSS. Consequently, DSP 310 may comprise an SS processor 315. Blind source separation is a known mathematical premise for signal processing, which provides that if N sources of audio streams are mixed and captured by N microphones (N mixtures), then it is possible to separate the resulting mixtures into N original audio streams. A discussion of blind source separation can be found in Blind Source Separation—Advances in Theory, Algorithms, and Applications, Ganesh R. Naik, Wenwu Wang, Springer Verlag, Berlin, Heidelberg, 2014, incorporated by reference herein.

However, the results of BSS generally have been insufficient if the N mixtures are not mutually linearly independent. In a headset or other head-worn device application, it is known that the desired voice/speech emanates from a specific direction relative to the microphones. However, the direction of noise is generally not known. Noise is most annoying when it is a so-called "distractor speech", in particular when it originates from a specific unknown direction. Thus, DSS may be used.

In the present embodiment, the DSP 310 thus comprises a directivity pre-processor 313 with a voice activity detector (VAD) 314. Directivity pre-processor 313 may pre-process the microphone signals of microphones 305A-305E and provides a voice signal and a noise signal to the SS processor 315. This pre-processing serves to improve the functioning of the SS processor 315 and to alleviate the fact that the direction of the noise is not known. VAD 314 is operable to perform speech processing on, and to detect human speech within, the noise suppressed input signals. VAD 314 comprises corresponding internal filters (not shown) to filter non-stationary noise from the noise suppressed input signals. This enhances the speech processing. VAD 314 estimates the presence of human speech in the audio received at the microphones 305A-305E. VAD 314 may be implemented by analog circuitry, digital circuitry, instructions for execution by a processor, or any suitable combination thereof.

Figure 4:
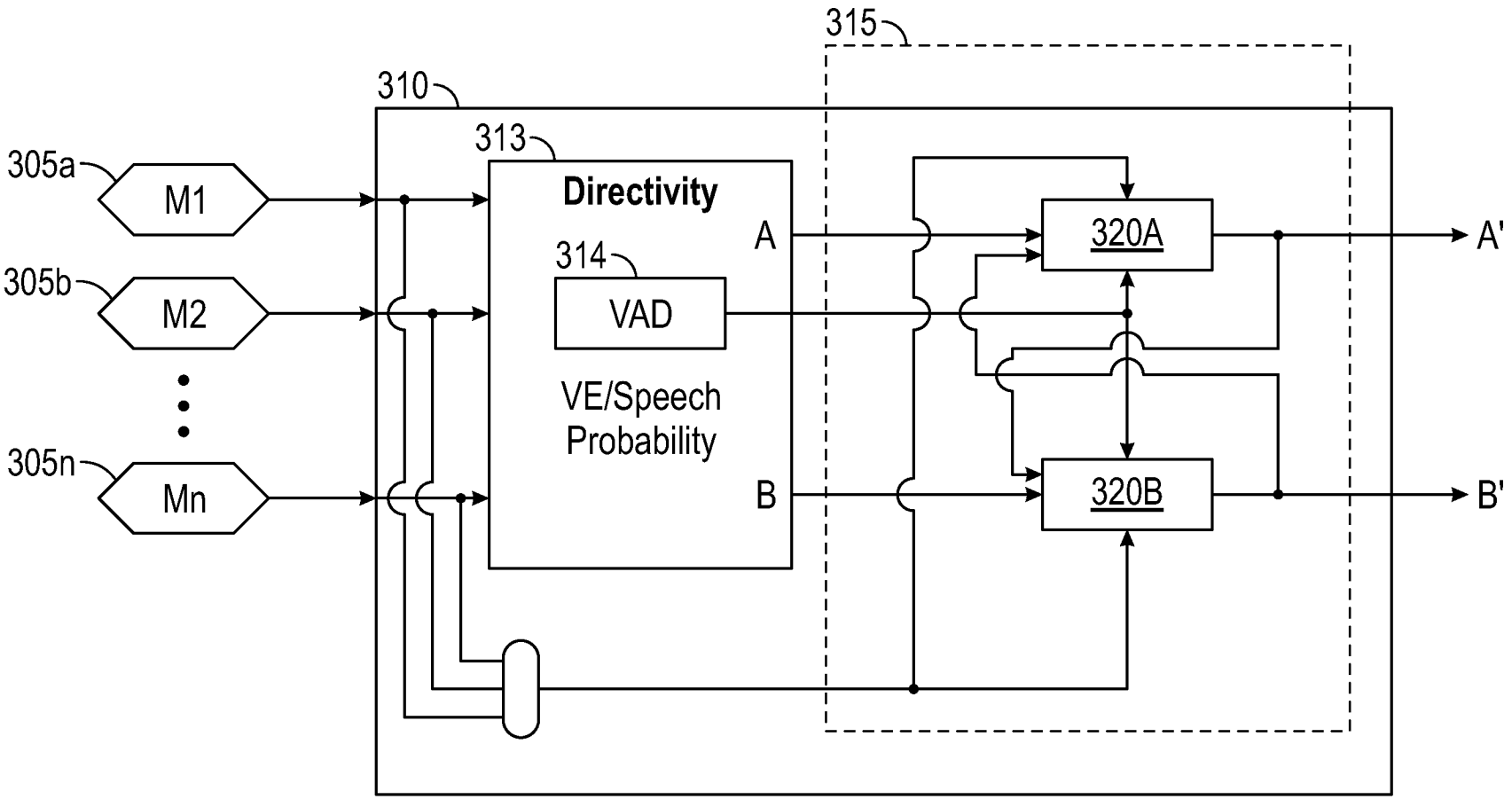
FIG. 4 shows a further detailed portion of the circuit for the headset, including a more detailed view of a digital signal processor, according to embodiments of the present disclosure.

FIG. 4 shows a schematic block diagram of an embodiment of DSP 310, according to embodiments of the present disclosure. It is noted that FIG. 3 shows microphone signals mic1-micN 305A-305N as inputs to the directivity pre-processor 313. The directivity pre-processor 313 has two outputs, which may include a voice signal output and a noise signal output, or two channels corresponding to different microphones. These may be denoted as channel A and channel B. Both outputs are connected with the SS processor 315, which corresponds to a known setup of a BSS or DSS processor. Furthermore, one or more of microphone signals mic1-micN 305A-305N may be inputs into SS processor 315.

SS processor 315 may be implemented by analog circuitry, digital circuitry, instruction for execution by a processor, or any suitable combination thereof. SS processor 315 may include filters 332A, 332B. These may be connected in a recursive, cross-coupled, or feedback manner. Filters 332A, 332B may thus improve operation over time in a statistical process by comparing the filtered signal with the originally provided (and properly delayed) signal.

SS processor 315 may also include pre-filters (not shown) to filter each signal path, i.e., the "mostly voice" and the "mostly noise" path. These pre-filters may serve to restore the (voice/noise) fidelity of the respective voice and noise signal. This is done on the "voice processing side" by comparing the voice signal at output of the directivity pre-processor 313 with a microphone signal, directly provided by one of microphone 105. If the microphone signal is not pre-processed, it is considered to have maintained true fidelity. Similarly, and on the "noise processing side", the noise signal output from directivity pre-processor 313 is compared with a microphone signal to restore true fidelity.

The term "fidelity" is understood with its typical meaning in the field of audio processing, denoting how accurately a copy reproduces its source. True fidelity may be restored by using corresponding (fixed) equalizers.

In one embodiment, output of VAD 314 may be used to determine a probability that outputs of directivity processor 313 includes speech, or to determine another measure of voice estimation (VE). VE may be used by SS processor 315 to filter, tune, or otherwise evaluate channels A and B. VE may be expressed as a decimal number.

Referring again to FIG. 2 in view of FIG. 4, VAD 314 may be configured to provide a VE estimate for a set of blocks of data collected by circuit 300 from microphones 105. There may be a block of data collected for each of microphones 105. Each block of data may be of any suitable size. Each block of data may be of a certain number of samples, or samples sufficient to sample a certain length of time. For example, each block of data may be 4 milliseconds long, representing timeslots or samples sampled at 16 KHz. The number of samples or timeslots in the block of data may be given as n. A given block of data for a microphone 105N may be represented as $f_{micN}(n)$. Thus, VAD 314 may sample or access, for example, $f_{mic1}(n)$, $f_{mic2}(n)$, $f_{mic3}(n)$, and $f_{mic4}(n)$, each representing the samples n for a given period of time from mic1 105A, mic2 105B, mic3 105C, mic4 105D forming a set of blocks of data.

VAD 314 may be configured to generate a fast Fourier transform (FFT) of each block of data. VAD 314 may be configured to apply any suitable FFT function to each block of data. The result of applying the FFT may be a representation of the block of data in the frequency domain. For example, the blocks of data represented in the time domain by $f_{mic1}(n)$, $f_{mic2}(n)$, $f_{mic3}(n)$, and $f_{mic4}(n)$ may be transformed into the frequency domain, represented by M1, M2, M3, and M4, respectively.

After obtaining the blocks of data and transforming them into frequency domain representations, VAD 314 may be configured to analyze the block of data to determine the VE for the block of data. The VE generated by VAD 314 for the samples n generating the blocks of data $f_{micN}(n)$ may be represented by VE.

Moreover, VE may be determined by evaluated VE ascontributed by the set of distractor angles 202 of the model shown in FIG. 2. The contributions by the set of distractor angles 202 for VE may be represented as $VE_1$, $VE_2$, $VE_3$, $VE_4$, and $VE_5$, corresponding to distractor angle 202A, distractor angle 202B, distractor angle 202C, distractor angle 202D, and distractor angle 202E. In one embodiment, VAD 314 may be configured to select a VE from a minimum value of the set of VE contributions by the set m of distractor angles 202. Thus, VE may be given as:

$$VE(N_m)=\mathrm{MIN}(VE_1, VE_2 \ldots VE_{Nm}) \quad \text{Equation 1}$$

wherein each of $VE_1$, $VE_2$, . . . $V_{Nm}$ represent the VE that would be represented by microphones 105 along an individual distractor angle. The voice estimate is thus considered to be the lowest voice estimate given the greatest possible amount of interference caused by noise modeled along the various distractor angles 202. VAD 314 evaluates each of the VE values for the different distractor angles and selects the minimum value of these VE values, and produces it as the overall VE value provided to, for example, SS processor 315. The lower the overall VE value, the higher the expectation that the signals generated by microphones 105 include wanted signals, such as wanted human voice. Unwanted signals might include distractor signals also generated by human voice, albeit unwanted human voice from others than the user of headset 100, as well as other background noise. The overall VE value may be a real number. Nevertheless, the overall VE value may be based upon a minimum value of the set of VE values ($VE_1$, $VE_2$, . . . $V_{Nm}$) for each individual microphone, which in turn may be expressed as complex numbers with a real and an imaginary component.

The VE for each individual microphone 105 may be given by:

$$VE_m=FX-g_m*FY_m \quad \text{Equation 2}$$

This relationship may be developed while estimating and modelling DSS behavior. FX and FY may be factors in this calculation. Moreover, g may be a multiplier of FY. Each of FX, FY, and g may be specific to the given distractor angle 202.

FX and FY may be calculated or set according to the position of the distractor angle for the $VE_m$ to be calculated. For example, with reference to FIG. 2, distractor angles at 0°, +90°, or +45°, FX and FY may be given as:

$$FX=M_1-M_2 \quad \text{Equation 3}$$

$$FY=M_3 \quad \text{Equation 4}$$

Thus, FX for each of the distractor angles may be the difference between the frequency counterpart (M1) of the time domain data collected by mic1 (M1) and the frequency counterpart (M2) of the time domain data collected by mic2. FY may be the frequency counterpart (M3) of the time domain data collected by mic3.

Furthermore, with reference to FIG. 2, for a distractor angle at −45° or −90°, FX and FY may be given as:

$$FX=M_1-M_2 \quad \text{Equation 5}$$

$$FY=M_4 \quad \text{Equation 6}$$

Thus, FX for these distractor angles may be the difference between the frequency counterpart (M1) of the time domain data collected by mic1 (M1) and the frequency counterpart (M2) of the time domain data collected by mic2. FY may be the frequency counterpart (M4) of the time domain data collected by mic4. Accordingly, FX may be the same for all distractor angles, but FY may vary, depending upon which distractor angle is used. Thus, FX may be referenced simply as FX, while FY may be referenced as $FY_m$. The factor $g_m$ may represent DSS coefficients that are predetermined and stored in, for example, a register or other memory. These may be developed according to the specific distractor angles that are used to model noise. The factor $g_m$ may be calibrated to reduce directional noise leak as much as possible.

However, inventors of embodiments of the present disclosure have discovered that microphones mic3 and mic4 may have jitter or delay compared to signals from microphones mic1 and mic2. This may arise, for example, by implementation of mic3 and mic4 as digital microphones, and mic1 and mic2 as analog microphones, or vice-versa. The difference in implementation of microphones may cause random delay. Moreover, inventors of embodiments of the present disclosure have discovered that when the microphone frequency response of, for example, mic1 and mic2 differ from microphones mic3 and mic4, incompatibilities may arise.

For example, suppose that microphone mic3 has a delay, τ, over microphone mic1. The comparison of mic3 and mic1 may be chosen as mic1 and mic2 might both be analog microphones and mic3 and mic4 might both be digital microphones. Synchronizing two digital microphones together, or synchronizing two analog microphones together, may be performed in other hardware or software (not shown). However, synchronizing between a hardware microphone (such as mic1) and a digital microphone (such as mic3) may be difficult, and may be addressed by embodiments of the present disclosure. To consider the delay, τ, Equation 2 becomes $$VE_m^{\tau}=FX_m-g_m*FY_m^{\tau}=FX_m-g_m*FY_m*e^{-j\omega\tau} \quad \text{Equation 7}$$

Thus, the bigger that τ becomes, the larger that the difference between $VE_m^{\tau}$ and $VE_m$ for the given distractor angle. Voice estimation is far less accurate, and distracting noise may become a problem.

Evaluation of a minimum value among the set of candidate VE values may be performed in any suitable manner. Because each of the $VE_1$, $VE_2$, etc. elements of the set of candidate VE values are complex numbers, a comparison between these elements may be performed in through several different techniques. Each VE value ($VE_m$) may be of the form ($a_i$, $b_i$), wherein a=($a_0$, $a_1$, . . . $a_{Nt-1}$) and b=($b_0$, $b_1$, . . . $b_{Nt-1}$). The term Nt may be the number of processing size which may depend upon the FFT frame size used to transform data from the time domain to the frequency domain. The a terms may refer to the FX values of Equations 2-7. In other words, a may be (M1-M2). The b terms may refer to the $g_m*FY_m$ values of Equations 2-7. In other words, b may be $g_m$*M3 or $g_m$*M4, depending upon the distractor angle in question. Moreover, specific values of $g_m$—referenced as $g_1$, $g_2$, etc.—may be selected according to the distractor angle, indexed as m. Each set of ($a_i$, $b_i$), and each of M1, M2, M3, M4, and $g_m$ may each be complex numbers.

Thus, a comparison of different instances of sets of these data may be performed through several different techniques. For example, each $VE_m$ may be evaluated according to ($|a_i|$-$|b_i|$) using the set of ($a_i$, $b_i$) values for the $VE_m$ that collectively make up the FX (for "a") or $g_m*FY_m$ (for "b"), and the minimum such $VE_m$ may be selected by the MIN function. This is a comparison using absolute value. In another example, each $VE_m$ may be evaluated according to ($a_i^2$-$b_i^2$), and the minimum such $VE_m$ may be selected by the MIN function.

Embodiments of the present disclosure may estimate τ without knowing a source of a change in τ. The value of τ may also change from, for example, adjustment of boom 104, thus moving microphones further or closer to one another. In one embodiment, the estimation of τ might not be performed explicitly, but implicitly, wherein the effects of possible $\tau$ values are evaluated and the best match for a resultant VE calculation may be used.

In one embodiment, VAD 314 may be configured to apply an algorithm to search within a range of values of possible delay for a best estimate of the delay. During the search, applying the possible delay to the data measured from the microphones 105 to the calculation of VE values for each distractor angle 202 may yield possible VE data values. The minimum VE of the set may be chosen as VE, as discussed above.

The possible range of delays may be described as a delay boundary. The delay boundary may be defined in terms of the time domain, but may have analogs in the frequency domain. For example, a delay in the time domain may be expressed as a phase shift in the frequency domain. The delay boundary may be given as $[-\delta, +\delta]$. The delay boundary may be around 22 timeslots or samples, for example, although the specific delay boundary may be characterized for a given pair of microphones 105 in any design. Thus, the range of possible delay values between mic1 and mic3 may have been determined to typically be within the range of [−11, 11].

In order to more efficiently search for an approximate delay value, the delay boundary may be divided into segments, wherein a single candidate delay value for the segment is used for evaluation. The delay boundary may be divided into any suitable quantity of segments, given as s. For example, the range of [−11, 11] may be divided into three segments. The more segments that are used, the more accurate that the estimation may be, but may require more processing power. For a given segment, an endpoint, or midpoint, or any suitable representative value from the segment may be used.

For each segment, a candidate delay value may be chosen from the range boundary. This may be represented by $\Delta_i$. The candidate delay value may be an integer or a non-integer. Then, a representative value of $f_{mic3}$, or its frequency equivalent M3, may be returned using the candidate delay value to offset a given index of the samples or timeslots (which may in turn be denoted by n). This may be performed by accessing the block of data in which $f_{mic3}$ values are stored. Based upon this representative value of $f_{mic3}$, or its frequency equivalent M3, $VE_m$ values may be calculated for each distractor angle 202. This may be performed using the calculations of Equations 2-6. Then, the smallest value among the $VE_m$ values may be selected as the VE for the block of data. Moreover, such a VE selection for the given segment may be compared against previous VE selections for previous segments, and the smallest such value among all the evaluated segments may be chosen as the output VE of VAD 314.

For example, suppose the delay boundary $\delta$ value is 10, thus yielding a boundary range of [−10, 10]. Then, presume that s is three. For the three-step search, the boundary range is divided into three, yielding representative values of −5, 0, and +5. Each of these three values is used as a candidate delay value in a calculation of VE. The minimum VE from the use of these three candidate delay values is chosen as the output VE. If more processing resources were available, each of [−10, −9 . . . 0, 1, . . . 9 10] might be used as candidate delay values, but this might not be a practical solution. Furthermore, by adjusting for the delay so that VE might be of a minimum value, higher suppression may be performed on distractor signals.

Moreover, if the actual value of $\tau$ were known, the calculations of Equation 7, when applied to Equation 1 and the minimum such candidate VE value is found, the minimum value embodied by this VE provides information for DSS processing elsewhere in the system to achieve the desired suppression on distractor signals. In other words, in theory, application of Equation 7 might yield the highest suppression. However, calculation of the exact value of $\tau$ might not be practical, as discussed above. Thus, embodiments of the present disclosure might perform searches of candidate VE values using approximations of candidate values of $\tau$. These VE values, while not ideal as would be calculated by Equation 7, may nevertheless provide enhanced distractor suppression and may be achievable by lower processing power available to headset 100.

The search for a minimum candidate VE value given different possible delays may utilize Equation 2 wherein (M1-M2) is close to zero. This may be achievable because mic1 and mic2 are close together and capture most of the voice signal, while mic3 is further away. So, when M3 is approximately zero, then no distractor signal is presented, and VE is close to zero, and thus the resultant signal may be determined to be voice. But, when M3 is not approximately zero, VE may get bigger. Thus, suppressing more noise by using a proper $g_m$ value, VE is made again to be approximately zero.

The following pseudocode is provided as a non-exhaustive example, and is not intended to be limited to any particular implementation, programming language, or syntax. Pseudocode for the algorithm may be given as:

```
initialize minVE; /* output VE value */
initialize Nm; /* count of distractor angles */
initialize VE[m] /* VE components for each distractor angle */
initialize n; /* array of samples/timeslots data */
initialize δ;
initialize boundary[−δ, δ]; /* range of possible delay boundaries */
initialize s; /* segments to divide boundary */
initialize Δ[s]; /* array of candidate delays to be applied */
initialize g[Nm];
M1 = FFT(fmic1(n));
M2 = FFT(fmic2(n));
M4 = FFT(fmic4(n));
for (i=0; i<s; i++ {
  Δ[i] = boundary[i/s];
  M3=FFT(fmic3(n− Δ[i]));
  for (m=0; m<Nm; m++) {
    calculate VE[m];
  }
  minVE = MIN (minVE, MIN (VE[ ]));
}
return minVE;
```

Thus, at each step of the algorithm, a possible delay value may be varied. This delay value may be used to retrieve a delayed data value from $f_{mic3}(n)$. The delayed data value may be transformed into the frequency domain, if not already stored in the frequency domain. With the delayed data value, M3 may be calculated, and with the already existing values of M1, M2, and M4, along with $g_m$, FX, and FY, values of VE for each distractor angle 202 may be calculated, yielding VE1, VE2, etc. With these VE values for each distractor angles, the minimum VE value that has been calculated may be saved as a candidate VE value. This itself may be compared with previously determined VE values. The minimum of these may be returned as the output VE. This may be used as output of VAD 314.

Moreover, suppose that the frequency response of mic3 may vary between different instances produced by different manufacturers or in different production batches. The factors FX and FY of Equation 2 may change, and may be denoted as $M_y^j$. Equation 2 may then become:

$$VE'_m = FX' - g_m * FY'_m \quad \text{Equation 8}$$

Since VE and VE' are different for different instances of the same microphone and $g_m$ set of values, the VE that is used might not correctly estimate its target.

It may be assumed that, while the frequency responses of different microphones are different, such a frequency response may remain generally consistent over time. However, the characteristics of frequency response, embodied in $g_m$, might be different between microphones of the same make and model. That is, a different production run or manufacture of the same microphone might yield microphones with different frequency response characteristics.

Accordingly, multiple sets of $g_m$ characteristics may be used for VE calculations, wherein each microphone, or set of microphones, may most closely match a given specific $g_m$ from the set. The sets of $g_m$ characteristics to be used may reflect a range of possible values given observed variances in manufacturing or production results. More possible sets of $g_m$ characteristics may yield more accurate results at a cost of more execution time to find VE. The number of different $g_m$ characteristic groups may be given as k. Thus, Equation 2 may be rewritten as $$VE_{m,k} = FX - g_{m,k} * FY_m \quad \text{Equation 9}$$

Operations of VAD 314 may include searching the set of k different $g_m$ characteristic groups for a best match, manifested by a lowest VE value. As discussed above, the set of k different $g_m$ characteristic groups may be established as the most common variations of $g_m$ characteristics observed during production of the microphones. While an individual instance of a microphone could have its own unique $g_m$ value, determining such a value at production and embedding this value in headset 100 might not be a practical solution. Thus, for a given microphone, VAD 314 may be configured to find a representative $g_m$ value among the set of k different $g_m$ characteristic groups. Any suitable criteria may be used. For example, the $g_m$ characteristic yielding the lowest VE value may be used.

Pseudo code for this process may be given as

```
initialize minVE; /* output VE value */
initialize Nm; /* count of distractor angles */
initialize n; /* array of samples/timeslots data */
initialize δ;
initialize boundary[−δ, δ];
initialize s; /* segments to divide boundary */
initialize Δ[s];
initialize h; /*quantity of sets of candidate gm values */
initialize g[Nm][h];
initialize VE[Nm][h]/* VE components for each distractor
angle and candidate gm
value */
M1 = FFT(fmic1(n));
M2 = FFT(fmic2(n));
M4 = FFT(fmic4(n));
for (i=0; i<s; i++ {
  Δ[i] = boundary[i/s];
  M3=FFT(fmic3(n− Δ[i]));
  for (k=0; k<h; k++ {
    for (m=0; m<Nm; m++) {
      calculate VE[m][k] using g[m][k];
    }
    minVE = MIN (minVE, MIN (VE[ ][k]));
  }
}
```

At the end of the search for VE values through different delay values, the minimum value for VE may be returned. This may be used as output of VAD 314.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module or other unit may fulfill the functions of several items recited in the claims.

The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

What is claimed is:

1. An apparatus, comprising:

a plurality of interfaces for communicatively coupling with a plurality of microphones;

a separated source processor configured to analyze a plurality of channels from the plurality of microphones; and a voice activity detector (VAD) circuit, connected to the separated source processor; the voice activity detector (VAD) circuit being configured to:

generate a voice estimate (VE) value, the VE value to indicate a likelihood of human speech received by one or more microphones of the plurality of microphones, wherein generating the VE value includes adjusting the VE value based upon evaluating a range of possible values of a delay between two microphones of the plurality of microphones; and provide the VE value to the separated source processor.

2. The apparatus of claim 1, wherein the VAD circuit is further configured to adjust the VE value by selecting a lowest candidate VE value given a range of possible values of the delay.

3. The apparatus of claim 1, wherein the VAD circuit is further configured to adjust the VE value based upon adjustment of a physical position of at least one of the plurality of microphones.

4. The apparatus of claim 1, wherein the VAD circuit is further configured to adjust the VE value based upon a frequency response of at least one of the plurality of microphones.

5. The apparatus of claim 4, wherein the VAD circuit is further configured to adjust the VE value by evaluating a range of possible values of characteristics representing the frequency response of at least one of the plurality of microphones.

6. The apparatus of claim 1, wherein the VAD circuit is further configured to adjust the VE value by selecting a lowest candidate VE value given a range of possible values of characteristics representing a frequency response of at least one of the plurality of microphones.

7. A method, comprising:

receiving input signals from a plurality of microphones;

generating a voice estimate (VE) value, the VE value to indicate a likelihood of human speech received by one or more microphones of the plurality of microphones, wherein generating the VE value includes adjusting the VE value based upon evaluating a range of possible values of a delay between two microphones of the plurality of microphones; and providing the VE value to a separated source processor.

8. The method of claim 7, further comprising adjusting the VE value by selecting a lowest candidate VE value given a range of possible values of the delay.

9. The method of claim 7, further comprising adjusting the VE value based upon adjustment of a physical position of at least one of the plurality of microphones.

10. The method of claim 7, further comprising adjusting the VE value based upon a frequency response of at least one of the plurality of microphones.

11. The method of claim 10, further comprising adjusting the VE value by evaluating a range of possible values of characteristics representing the frequency response of at least one of the plurality of microphones.

12. The method of claim 7, further comprising adjusting the VE value by selecting a lowest candidate VE value given a range of possible values of characteristics representing a frequency response of at least one of the plurality of microphones.

13. An article of manufacture, comprising a non-transitory medium, the medium including instructions, the instructions, when loaded and executed by a processor, cause the processor to:

receive input signals from a plurality of microphones;

generate a voice estimate (VE) value, the VE value to indicate a likelihood of human speech received by one or more microphones of the plurality of microphones, wherein generating the VE value includes adjusting the VE value based upon evaluating a range of possible values of a delay between two microphones of the plurality of microphones; and provide the VE value to a separated source processor.

14. The article of claim 13, further comprising instructions to adjust the VE value by selecting a lowest candidate VE value given a range of possible values of the delay.

15. The article of claim 13, further comprising instructions to adjust the VE value based upon a frequency response of at least one of the plurality of microphones.

16. The article of claim 15, further comprising instructions to adjust the VE value by evaluating a range of possible values of characteristics representing the frequency response of at least one of the plurality of microphones.

17. The article of claim 13, further comprising instructions to adjust the VE value by selecting a lowest candidate VE value given a range of possible values of characteristics representing a frequency response of at least one of the plurality of microphones.

18. An apparatus, comprising:

a plurality of interfaces for communicatively coupling with a plurality of microphones;

a separated source processor configured to analyze a plurality of channels from the plurality of microphones; and a voice activity detector (VAD) circuit, connected to the separated source processor; the voice activity detector (VAD) circuit being configured to:

generate a voice estimate (VE) value, the VE value to indicate a likelihood of human speech received by one or more microphones of the plurality of microphones, wherein generating the VE value includes adjusting the VE value based upon a delay between two microphones of the plurality of microphones and adjusting the VE value based upon a frequency response of one or more of the plurality of microphones; and provide the VE value to the separated source processor.

19. A method, comprising:

receiving input signals from a plurality of microphones;

generating a voice estimate (VE) value, the VE value to indicate a likelihood of human speech received by one or more microphones of the plurality of microphones, wherein generating the VE value includes adjusting the VE value based upon a delay between two microphones of the plurality of microphones and adjusting the VE value based upon a frequency response of one or more of the plurality of microphones; and providing the VE value to a separated source processor.

20. An article of manufacture, comprising a non-transitory medium, the medium including instructions, the instructions, when loaded and executed by a processor, cause the processor to:

receive input signals from a plurality of microphones;

generate a voice estimate (VE) value, the VE value to indicate a likelihood of human speech received by one or more microphones of the plurality of microphones, wherein generating the VE value includes adjusting the VE value based upon a delay between two microphones of the plurality of microphones and adjusting the VE value based upon a frequency response of one or more of the plurality of microphones; and provide the VE value to a separated source processor.

* * * * *